United States Patent [19]

Freermann et al.

[11] 4,421,044

[45] Dec. 20, 1983

[54] AUTOMATIC METHOD AND APPARATUS FOR FEEDING A TEXTILE PIECE TO A SEWING MACHINE

[75] Inventors: Johannes Freermann; Dieter Malcherek, both of Ochtrup, Fed. Rep. of Germany

[73] Assignee: Carl Schmale KG, Ochtrup, Fed. Rep. of Germany

[21] Appl. No.: 358,813

[22] Filed: Mar. 16, 1982

[51] Int. Cl.[3] ..... D05B 97/00; D05B 27/16

[52] U.S. Cl. ..... 112/262.3; 112/304; 112/312; 112/148

[58] Field of Search ..... 112/262.3, 262.1, 312, 112/304, 148

[56] References Cited

U.S. PATENT DOCUMENTS

| | | | |
|---|---|---|---|
| 955,619 | 4/1910 | Veatch | 112/148 |
| 3,800,719 | 4/1974 | Rockerath | 112/304 |
| 3,850,121 | 11/1974 | Speer | 112/312 X |
| 3,871,312 | 3/1975 | Rockerath et al. | 112/304 |
| 3,906,878 | 9/1975 | Burton | 112/304 X |
| 4,104,977 | 8/1978 | Pollmeier et al. | 112/148 X |
| 4,311,106 | 1/1982 | Hanneman | 112/304 X |

FOREIGN PATENT DOCUMENTS

| | | | |
|---|---|---|---|
| 1685037 | 1/1973 | Fed. Rep. of Germany | 112/147 |
| 2343847 | 3/1976 | France | 112/148 |

*Primary Examiner*—H. Hampton Hunter
*Attorney, Agent, or Firm*—Karl F. Ross

[57] ABSTRACT

A piece of loose textile with a spread cut edge is fed to a stitching location in accordance with a method wherein the piece is gripped at an interior location spaced from the edge and this interior gripped location is advanced continuously at an intermediate transport speed in a transport direction parallel to the edge toward the stitching location. Thus relative to the direction the edge has a leading portion and a trailing portion that are successively displaced past a speed-change location. This leading portion of the edge is advanced in the direction toward the stitching location at a relatively slow transport speed slower than the intermediate speed and the trailing portion of the edge is advanced in the direction toward the stitching location at a relatively fast transport speed faster than the intermediate speed. This system therefore automatically rectifies the edges of the piece. The normally forwardly splayed portion of the cut edge of a piece of loose material such as frottee is retarded and the rearwardly splayed portion of this cut edge is accelerated. As a result the leading and trailing edges of the piece will be straight, parallel, and perpendicular to the transport direction.

10 Claims, 2 Drawing Figures

AUTOMATIC METHOD AND APPARATUS FOR FEEDING A TEXTILE PIECE TO A SEWING MACHINE

FIELD OF THE INVENTION

The present invention relates to an automatic method and apparatus for feeding a textile piece to a sewing machine. More particularly this invention concerns the feeding of a piece of low-grade sponge cloth or frottee to an edging machine.

BACKGROUND OF THE INVENTION

A machine is known from German Pat. No. 1,685,037 which during edge-stitching of a cut or unselvaged piece of cloth folds the edges over each other in several stages, then presses them together, and finally fixes the folds. Thus the piece edges are folded over with out stretching.

Such an arrangement does not work, however, with splayed cut edges of sponge cloth or the like. The edges perpendicular to the cut edge have portions immediately adjacent this cut edge which are splayed out. When processed by a machine as described in the above-cited patent, these lobed or pointing-out edges are followed, making a bad edge.

OBJECTS OF THE INVENTION

It is therefore an object of the present invention to provide an improved method of and apparatus for feeding a textile piece to a sewing machine.

Another object is the provision of such a method and apparatus which overcome the above-described disadvantage.

A further object is to provide an improved piece feeder and method of operation same which allows even low-grade sponge cloth and the like to be fed to the stitching location with its leading and trailing edges aligned perpendicular to the transport direction.

SUMMARY OF THE INVENTION

These objects are attained according to the instant invention in a method wherein the piece is gripped at an interior location spaced from the edge and this interior gripped location is advanced continuously at an intermediate transport speed in a transport direction parallel to the edge toward the stitching location. Thus relative to the direction the edge has a leading portion and a trailing portion that are successively displaced past a speed-change location. This leading portion of the edge is advanced in the direction toward the stitching location at a relatively slow transport speed slower than the intermediate speed and the trailing portion of the edge is advanced in the direction toward the stitching location at a relatively fast transport speed faster than the intermediate speed.

This system therefore automatically rectifies the edges of the piece. The normally forwardly splayed portion of the cut edge of a piece of loose material such as frottee is retarded and the rearwardly splayed portion of this cut edge is accelerated. As a result the leading and trailing edges of the piece will be straight, parallel, and perpendicular to the transport direction.

According to this invention the intermediate speed is generally constant. It usually is the same as the speed of the input conveyor of the sewing machine at the downstream stitching location.

In accordance with another feature of this invention the trailing portion is advanced at the fast speed by being gripped between a pair of conveyor elements moving at the fast speed and the leading portion is advanced at the slow speed by being engaged by a brake to slip on the conveyor elements. Thus as the piece moves through the speed-change location where the brake is provided, it is first engaged and slowed by the brake, and then released by this brake and moved at a relatively high speed.

An apparatus according to this invention has inner conveyor means for gripping the piece at an interior location spaced from the edge and for advancing the interior gripped location at an intermediate transport speed in a transport direction parallel to the edge toward the stitching location, brake means for advancing the leading portion of the edge in the direction toward the stitching location at a relatively slow transport speed slower than the intermediate speed, and outer conveyor means for advancing the trailing portion of the edge in the direction toward the stitching location at a relatively fast transport speed faster than the intermediate speed.

These conveyor means each include respective pairs of belts extending in the direction and oppositely engaging and pinching the piece as well as drive means for advancing the belts where same engage the piece at respective constant speeds. The outer conveyor therefore always moves faster than the inner conveyor.

The brake means according to the invention has a fixed brake element engageable with one face of the piece adjacent the edge and a movable brake element pressable against the opposite face of the piece adjacent the edge in line with the fixed element. The movable element is a leaf spring extending generally in the direction and having one end fixed to the housing of the apparatus and another end in line with the fixed element and deflectable toward and away from the piece. A fluid-operated cylinder is fixed on the housing and engaged with the other end for moving same toward and away from the fixed element. Control means is connected to the brake means and provided with a sensor for detecting the leading and trailing edges of the piece and operating the brake means in accordance with the position thereof.

DESCRIPTION OF THE DRAWING

The above and other features and advantages will become more readily apparent from the following, reference being made to the accompanying drawing in which.

SPECIFIC DESCRIPTION

Figure 1:
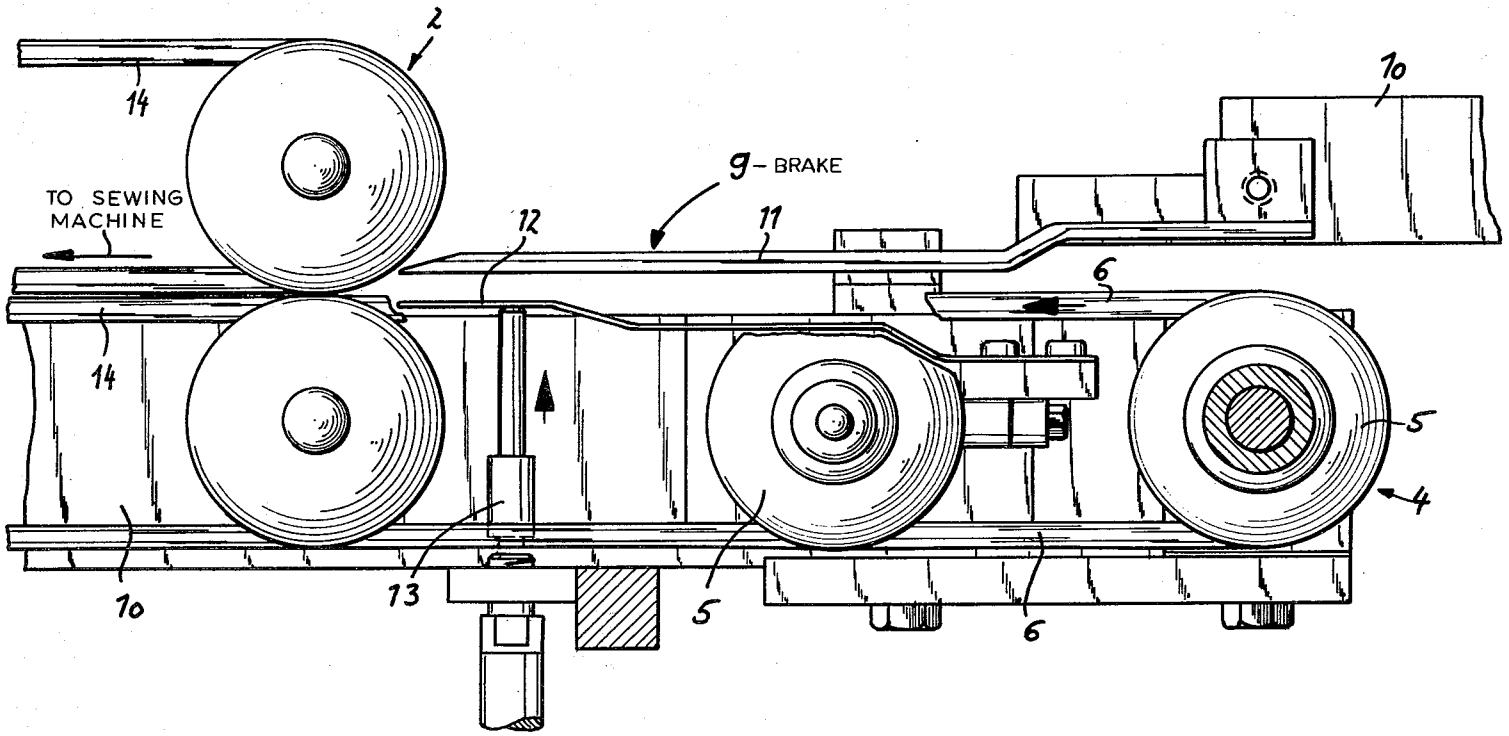
FIG. 1 is a side view of an apparatus for carrying out the method of this invention.
Figure 2:
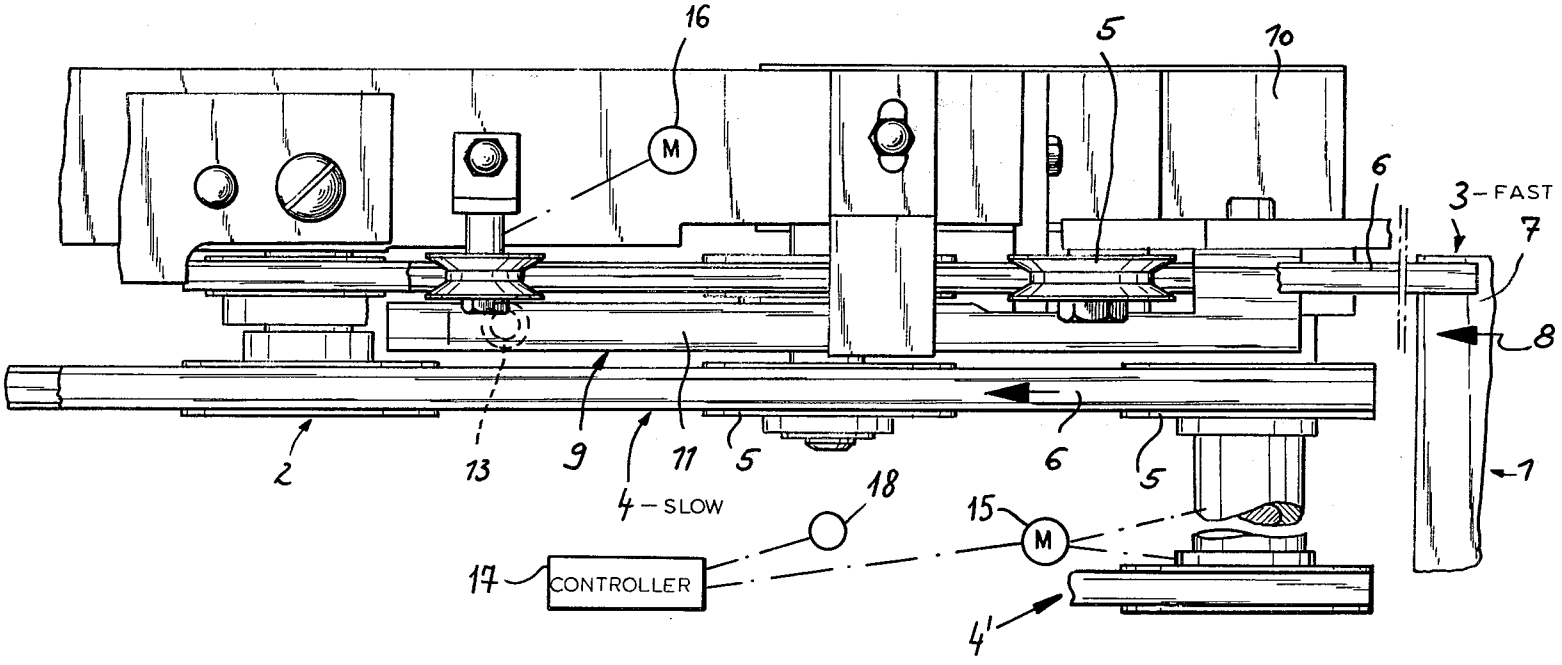
FIG. 2 is a top view of the apparatus of FIG. 1.

As seen in the drawing, a piece 1 of low-grade sponge cloth 1 has relative to a horizontal transport direction 8 a cut edge 7 that is to be stitched by a machine having an input feed arrangement 2 having a standard pair of pitch belts 14. The piece 1 is gripped according to this invention inside its edge 7 by a standard conveyor 4 having a pair of pinch V-belts 5 spanned over pulleys 6 and driven by a motor 15. This conveyor 4 in fact normally comprises a plurality of such pairs of pinch belts such as shown at 4', all driven synchronously by the motor 15 so that the entire piece 1 is advanced in the direction 8 at a constant intermediate speed $V_i$.

The edge 7 is gripped by another conveyor 3 constituted by belts 5 and pulleys 6 driven by another motor 16 and normally operating at a relatively fast speed $V_f$ somewhat faster than the intermediate speed $V_i$. Thus, absent outside influence, the edge 7 of the piece 1 will be advanced more rapidly than the interior portions of the piece 1.

According to this invention a brake 9 can act on the edge 7 immediately adjacent the extreme outer edge portion gripped by the conveyor 3. This brake 9 has an upper brake element 11 which extends in the direction 8 and which is attached to the machine housing 10. A leaf spring 12 extending in the direction 8 has an upstream end secured to the housing 10 and a downstream end. A small pneumatic cylinder 13 fixed on the housing 10 is operated by a microprocessor-type controller 17 in accordance with the position of the leading and trailing edges of the central portions of the piece 1 as determined by a photocell-type sensor 17. This brake 9 can grip the piece 1 with sufficient force to cause it to slip with respect to the belts 5 of the fast conveyor 3.

In use as the leading portion of the cut edge 7 passes under the brake 9 it is gripped thereby between the elements 11 and 12 so tightly that it is slowed to a speed $V_s$ substantially slower than the intermediate speed $V_i$. Thus this edge 7, which is normally spread by cutting so that it projects forwardly at the leading edge and backwardly at the trailing edge, is slowed so that its leading-edge portion is aligned with the rest of the leading edge of the piece 1 in a direction perpendicular to the direction 1. As the middle of the piece 1 passes the brake 9, the cylinder 13 relaxes so that the trailing portion of the edge 7 is advanced at the fast speed $V_f$, which brings the trailing-edge portion of the edge 7 into line with the rest of the trailing edge of the piece 1, parallel to its leading edge.

In this manner by very simple means the leading and trailing edges of the piece 1 are repositioned so that when the piece 1 is stitched to something else, a smooth seam will result. This rectification of the piece 1 takes place wholly automatically as the piece 1 is slid off the work table into the apparatus, which simply constitutes an upstream extension of the input of the sewing machine.

We claim:

1. A method of feeding a textile piece having a nonstraight edge to a stitching location, said method comprising the steps of:

gripping said piece at an interior location spaced from said edge;

advancing said interior gripped location at an intermediate transport speed in a transport direction parallel to said edge toward said stitching location, whereby relative to said direction said edge has a leading portion and a trailing portion that are successively displaced past a speed-change location;

advancing said leading portion of said edge in said direction toward said stitching location at a relatively slow transport speed slower than said intermediate speed; and advancing said trailing portion of said edge in said direction toward said stitching location at a relatively fast transport speed faster than said intermediate speed.

2. The method defined in claim 1 wherein said intermediate speed is generally constant.

3. The method defined in claim 1 wherein said trailing portion is advanced at said fast speed by being gripped between a pair of conveyor elements moving at said fast speed and said leading portion is advanced at said slow speed by being engaged by a brake to slip on said conveyor elements.

4. An apparatus for feeding a textile piece having a nonstraight edge to a stitching location, said apparatus comprising:

inner conveyor means for gripping said piece at an interior location spaced from said edge and for advancing said interior gripped location at an intermediate transport speed in a transport direction parallel to said edge toward said stitching location, whereby relative to said direction said edge has a leading portion and a trailing portion that are successively displaced past a speed-change location;

brake means for advancing said leading portion of said edge in said direction toward said stitching location at a relatively slow transport speed slower than said intermediate speed; and outer conveyor means for advancing said trailing portion of said edge in said direction toward said stitching location at a relatively fast transport speed faster than said intermediate speed.

5. The apparatus defined in claim 4 wherein said conveyor means each include respective pairs of belts extending in said direction and oppositely engaging and pinching said piece.

6. The apparatus defined in claim 5 wherein said inner conveyor means includes drive means for advancing said belts where same engage said piece at a generally constant speed.

7. The apparatus defined in claim 5 wherein said brake means includes a fixed brake element engageable with one face of said piece adjacent said edge and a movable brake element pressable against the opposite face of said piece adjacent said edge in line with said fixed element.

8. The apparatus defined in claim 7 wherein said apparatus has a fixed housing and said movable element is a leaf spring extending generally in said direction and having one end fixed to said housing and another end in line with said fixed element and deflectable toward and away from said piece.

9. The apparatus defined in claim 8 wherein said brake means includes a fluid-operated cylinder fixed on said housing and engaged with said other end for moving same toward and away from said fixed element.

10. The apparatus defined in claim 9, further comprising control means connected to said brake means and provided with a sensor for detecting the leading and trailing edges of said piece and operating said brake means in accordance with the position thereof.

* * * * *